US006238235B1

(12) United States Patent
Shavit et al.

(10) Patent No.: US 6,238,235 B1
(45) Date of Patent: May 29, 2001

(54) CABLE ORGANIZER

(75) Inventors: Amir Shavit; Pinchas Shifris, both of Tel Aviv; Dmitry Gurevitz, Holon, all of (IL)

(73) Assignee: RIT Technologies Ltd., Tel Aviv (IL)

( * ) Notice: Subject to any disclaimer, the term of this patent is extended or adjusted under 35 U.S.C. 154(b) by 0 days.

(21) Appl. No.: 09/521,880

(22) Filed: Mar. 9, 2000

(30) Foreign Application Priority Data

Oct. 5, 1999 (IL) ..... 129883

(51) Int. Cl.[7] ..... H01R 4/24; H01R 4/26; H01R 11/20

(52) U.S. Cl. ..... 439/418

(58) Field of Search ..... 439/445, 694, 439/676, 418

(56) References Cited

U.S. PATENT DOCUMENTS

| | | | | |
|---|---|---|---|---|
| 5,160,273 | * | 11/1992 | Carney | 439/108 |
| 5,385,490 | * | 1/1995 | Demeter et al. | 439/579 |
| 5,571,035 | * | 11/1996 | Ferrill | 439/894 |
| 5,628,647 | | 5/1997 | Rohrbaugh et al. . | |
| 5,899,770 | * | 5/1999 | Ezawa | 439/418 |
| 5,967,801 | * | 10/1999 | Martin et al. | 439/76.1 |
| 6,007,368 | * | 12/1999 | Lorenz et al. | 439/418 |
| 6,083,052 | * | 7/2000 | Adams et al. | 439/676 |

OTHER PUBLICATIONS

Pair Lock Sled Assembly Product Description, Hubbel Premise Wiring (Catalogue pages), Jan. 1999, pp. 1–3.

International Standard CEI IEC 603–7, Part 7, Second Edition, 1996.

TIA TR–42.7.1. Committee Correspondence, TR–42.7.1–690, Jan. 12, 2000, pp. 1–4 (teleconference, meeting minutes).

TR–42.7.1. Work Group Contribution, PN–2948–XXX, pp. 1–12, May 11, 1999, "Comparative Study of Variability, Interoperability and Backwards Compatibility, including Results of a Very Low Variability Plug".

TIA TR–42.7.1. Committee Correspondence, TR–42.7.1–689, Nov. 9, 1999, pp. 1–4 (meeting minutes).

TIA TR–42.7.1. Committee Correspondence, PN–2948–651, Jun. 10, 1999, pp. 1–4 (meeting minutes).

RIT Technologies, Inc. "Summary of Publication History—with Regards to Our Cable Organizer Patent", p. 1.

RIT Technologies, Inc., "Test Fixture for Modular Plug De–Embedding NEXT and FEXT with High Consistency", Nov. 1, 1999, pp. 1–5.

http://www.solidworks.com/support2/viewer (web page):SolidWorks—SolidWorks Viewer, p. 1.

RIT Technologies Press Release, "RiT Announces 'CLASSix™', New Cat–6 Product Line", Jan. 18, 2000, Israel.

* cited by examiner

*Primary Examiner*—Brian Sircus
*Assistant Examiner*—Michael C. Zarroli
(74) *Attorney, Agent, or Firm*—Pillsbury Winthrop LLP

(57) ABSTRACT

A cable organizer including an elongate body having two opposite ends, one called a cable receiving end and the other called a terminal receiving end, and a plurality of wire-receiving passages formed in the elongate body and separated from each other by electrically conductive portions in the body, each wire-receiving passage extending from the cable receiving end to the terminal receiving end and being open at both ends, each wire-receiving passage being adapted for guiding therethrough a plurality of wires of a multi-pair communication cable from the cable receiving end to the terminal receiving end, and being adapted for arranging a plurality of wires of a multi-pair communication cable at the terminal receiving end for connection with a modular plug. The wire receiving passages have parallel but not coplanar surface portions that are joined by an intermediate portion. This causes a different wire receiving passage cross-section at the cable-receiving end compared to the terminal-receiving end.

16 Claims, 5 Drawing Sheets

FIG. 5
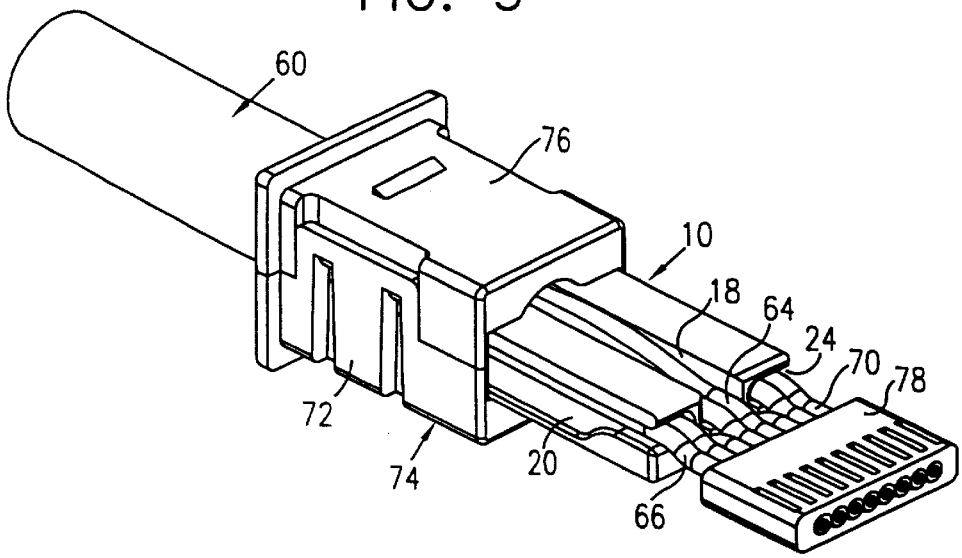
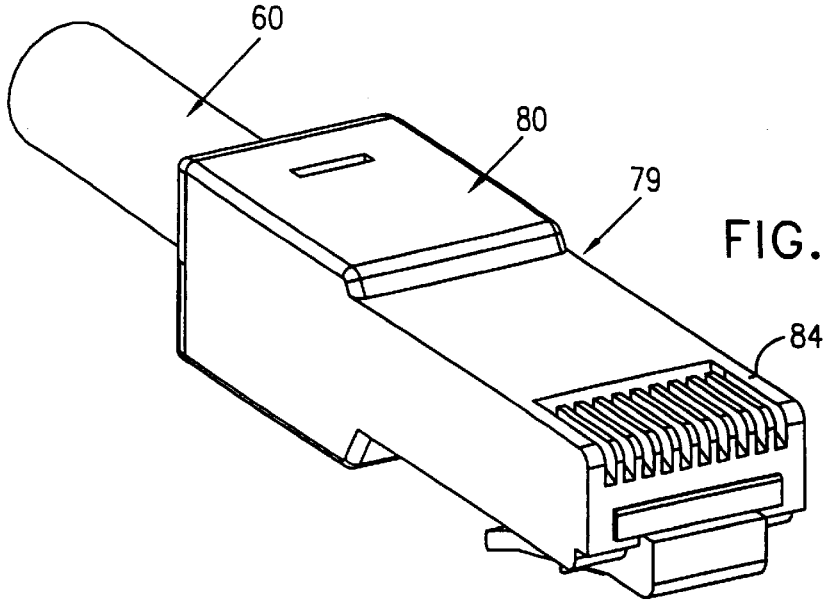
FIG. 6
FIG. 7
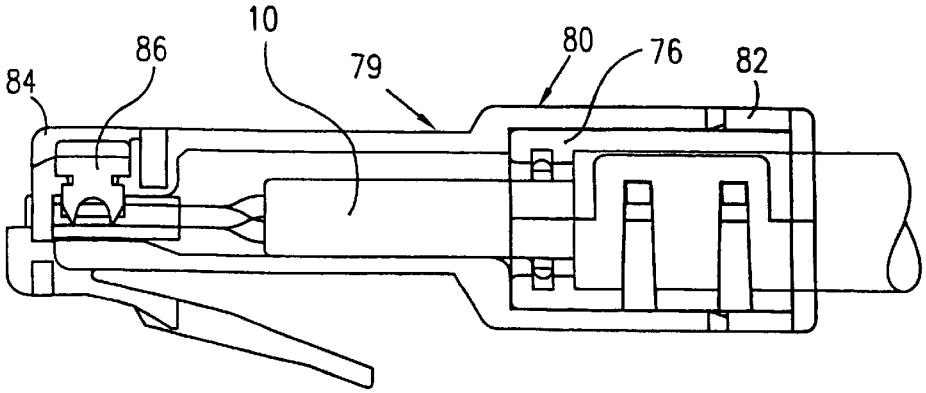

CABLE ORGANIZER

FIELD OF THE INVENTION

The present invention relates generally to electrical connector and cable assemblies and particularly to an organizer which reduces or eliminates cross-talk between twisted wire pairs of modular plug assemblies commonly used in the transmission of high frequency or telecommunication signals.

BACKGROUND OF THE INVENTION

Data communication networks and systems generally transmit data at high rates over a plurality of circuits that include multi-pair data communication cable, such as electrically distinct twisted wire pairs. At high transmission rates, each wiring circuit itself both transmits and receives electromagnetic radiation so that the signals flowing through one circuit or wire pair may couple with the signals flowing through another wire pair. The unintended electromagnetic coupling of signals between different pairs of conductors of different electrical circuits is referred to as cross-talk. The problem of cross-talk increases as the frequency of the transmitted signals increases.

In telecommunication systems, twisted wire pairs are often terminated in modular plugs. For example, modular plugs for telephone use are very commonplace and must meet the electrical performance requirements of industry standards, such as IEC 603-7. A problem with such modular plugs is that although cross-talk between twisted wire pairs in the cable leading to the plug is generally at negligible or at least tolerable levels, an intolerable amount of cross-talk between the wires can exist in the plug. One of the reasons for this is that insertion of the twisted wire pairs into the plug and electrical connection of the wires to electrical contacts in the plug generally requires that the wires be untwisted for a certain length, thereby leaving the wires prone to cross-talk.

Connectors are known which try to eliminate or reduce the problem of cross-talk between twisted wire pairs of modular plug assemblies. An example of such a plug assembly is described in U.S. Pat. No. 5,628,647 to Rohrbaugh et al. Another example is a plug assembly manufactured by Hubbell Incorporated, Stonington, Conn., USA, under the name PAIR LOCK stable-twist plug assembly, described in the January 1999 catalog of Hubbell Premise Wiring. This plug assembly is purported to maintain pair twist much farther into the plug, thereby reducing the level of cross-talk. However, this plug assembly is only applicable for flat cables.

SUMMARY OF THE INVENTION

The present invention seeks to provide a novel organizer which reduces or eliminates cross-talk between twisted wire pairs of modular plug assemblies. The organizer includes an elongate body having a cable receiving end and a terminal receiving end. A plurality of wire-receiving passages are formed in the elongate body, and separated from each other by electrically conductive portions in the body. Wire pairs of a multi-pair communication cable may be easily inserted into the cable receiving ends of the wire-receiving passages, and the wire pairs become automatically arranged at the terminal receiving ends for insertion into a terminal receiver, such as in accordance with the standard arrangement of IEC 603-7 modular plugs. The cable organizer substantially reduces or even eliminates cross-talk between the wire pairs by providing an electrically conductive barrier between the wire pairs up until the wire pairs are actually inserted into the terminal receiver.

There is thus provided in accordance with a preferred embodiment of the present invention a cable organizer including an elongate body having two opposite ends, one called a cable receiving end and the other called a terminal receiving end, and a plurality of wire-receiving passages formed in the elongate body and separated from each other by electrically conductive portions in the body, each wire-receiving passage extending from the cable receiving end to the terminal receiving end and being open at both ends, each wire-receiving passage being adapted for guiding therethrough a plurality of wires of a multi-pair communication cable from the cable receiving end to the terminal receiving end, and being adapted for arranging a plurality of wires of a multi-pair communication cable at the terminal receiving end for connection with a modular plug.

In accordance with a preferred embodiment of the present invention at least one of the wire-receiving passages has a different cross-section at the cable receiving end than at the terminal receiving end.

Further in accordance with a preferred embodiment of the present invention at least two of the wire-receiving passages are symmetrically arranged with respect to each other at the cable receiving end.

Still further in accordance with a preferred embodiment of the present invention at least two of the wire-receiving passages are symmetrically arranged with respect to each other at the terminal receiving end.

In accordance with a preferred embodiment of the present invention at least two of the wire-receiving passages are symmetrically arranged with respect to each other at the cable receiving end, but are arranged differently with respect to each other at the terminal receiving end.

Additionally in accordance with a preferred embodiment of the present invention at least one of the wire-receiving passages is coordinately positioned with respect to another of the wire-receiving passages differently at the cable receiving end than at the terminal receiving end.

In accordance with a preferred embodiment of the present invention at least one of the wire-receiving passages has a ramp formed therein at the terminal receiving end.

Further in accordance with a preferred embodiment of the present invention at least one of the wire-receiving passages has a bifurcation formed therein at the terminal receiving end, the bifurcation being adapted to separate two wires of a multi-pair communication cable.

Still further in accordance with a preferred embodiment of the present invention the plurality of wire-receiving passages includes at least four wire-receiving passages, a first wire-receiving passage being positioned on an upper surface of the elongate body, a second wire-receiving passage being positioned on a lower surface of the elongate body, a third wire-receiving passage being positioned on a left side surface of the elongate body, and a fourth wire-receiving passage being positioned on a right side surface of the elongate body.

Additionally longitudinal axes of the first and second wire-receiving passages are generally coplanar and parallel to each other at the cable receiving end.

In accordance with a preferred embodiment of the present invention longitudinal axes of the third and fourth wire-receiving passages are generally coplanar and parallel to each other at the cable receiving end.

Further in accordance with a preferred embodiment of the present invention longitudinal axes of the third and fourth wire-receiving passages are generally coplanar at the terminal receiving end.

Still further in accordance with a preferred embodiment of the present invention longitudinal axes of the first and second wire-receiving passages are generally coplanar and parallel to each other at the cable receiving end, longitudinal axes of the third and fourth wire-receiving passages are generally coplanar and parallel to each other at the cable receiving end, and a plane of the first and second wire-receiving passages is generally perpendicular to a plane of the third and fourth wire-receiving passages.

Additionally in accordance with a preferred embodiment of the present invention the elongate body includes pins adapted to align attachment of the elongate body to a modular plug.

In accordance with a preferred embodiment of the present invention a plurality of wires of a multi-pair communication cable are disposed in the wire-receiving passages from the cable receiving end to the terminal receiving end.

Further in accordance with a preferred embodiment of the present invention a modular plug is provided, wherein the plurality of wires of the multi-pair communication cable are connected to the modular plug at the terminal receiving end.

BRIEF DESCRIPTION OF THE DRAWINGS

The present invention will be understood and appreciated more fully from the following detailed description, taken in conjunction with the drawings in which:

FIG. 5 is a simplified pictorial illustration of inserting wires of the multi-pair communication cable into a terminal receiver of the modular plug; and FIGS. 6 and 7 are simplified pictorial and sectional illustrations, respectively, of assembling an outer dielectric housing of the modular plug over the inner portions and terminal receiver of the modular plug.

DETAILED DESCRIPTION OF PREFERRED EMBODIMENTS

Figure 1A:
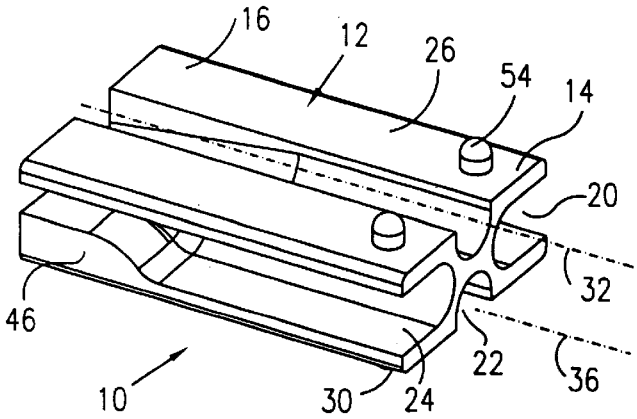
FIGS. 1A, 1B and 1C are simplified pictorial illustrations, from three different perspective views, of a cable organizer constructed and operative in accordance with a preferred embodiment of the present invention.
Figure 1B:
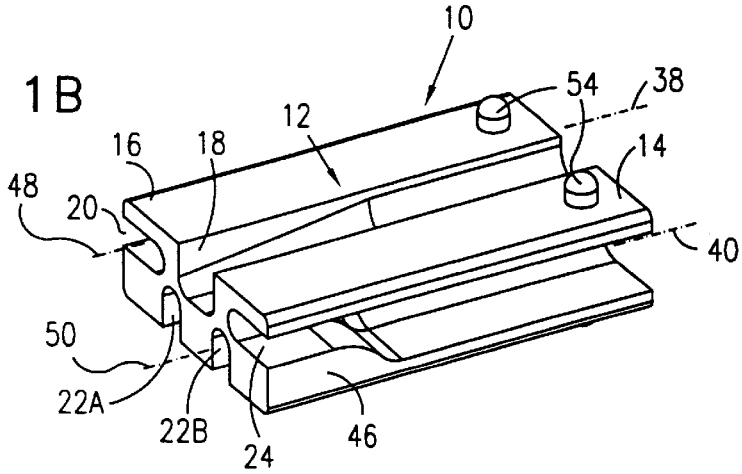
Figure 1C:
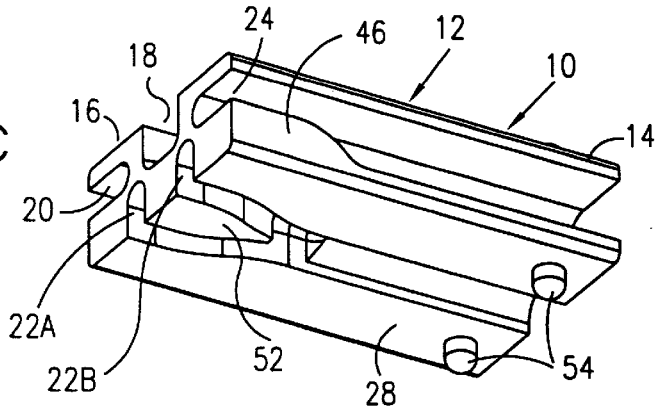

Reference is now made to FIGS. 1A, 1B and 1C which illustrate a cable organizer 10 constructed and operative in accordance with a preferred embodiment of the present invention.

Cable organizer 10 preferably includes an elongate body 12 having two opposite ends, one called a cable receiving end 14 and the other called a terminal receiving end 16. A plurality of wire-receiving passages are formed in elongate body 12. In the illustrated embodiment there are four wire-receiving passages 18, 20, 22 and 24. Wire-receiving passages 18, 20, 22 and 24 are separated from each other by electrically conductive portions in elongate body 12. Most preferably this is accomplished by constructing elongate body 12 completely of a metal, such as a copper alloy or an aluminum alloy. Alternatively, elongate body 12 may be made of a dielectric material, such as a plastic, with an electrically conductive coating or plating formed thereon, sufficient enough to substantially prevent electromagnetic interference which could cause cross-talk between wires placed in the wire-receiving passages. It is noted that the present invention can be carried out without elongate body 12 having any electrically conductive portion, however, there is somewhat of a degradation in performance.

Each of the wire-receiving passages 18, 20, 22 and 24 extends from cable receiving end 14 to terminal receiving end 16 and is open at both ends 14 and 16. Preferably wire-receiving passage 18 is positioned on an upper surface 26 of elongate body 12, wire-receiving passage 22 is positioned on a lower surface 28, wire-receiving passage 24 is positioned on a left side surface 30, and wire-receiving passage 20 is positioned on a right side surface 32, as viewed from cable receiving end 14. It is appreciated that other arrangements are possible within the scope of the present invention.

In accordance with one preferred embodiment of the present invention, at cable receiving end 14, longitudinal axes 34 and 36 of wire-receiving passages 18 and 22, respectively, are generally coplanar and parallel to each other. Longitudinal axes 38 and 40 of wire-receiving passages 20 and 24, respectively, are generally coplanar and parallel to each other. A plane 42 of wire-receiving passages 18 and 22 is generally perpendicular to a plane 44 of wire-receiving passages 20 and 24 (FIG. 1D).

In accordance with one preferred embodiment of the present invention, one or more of the wire-receiving passages (in the illustrated embodiment wire-receiving passages 20 and 24) have a ramp 46 formed therein at terminal receiving end 16. (Ramp 46 of wire-receiving passage 20 is not visible in FIGS. 1A–1C.) Due to the presence of ramp 46, wire-receiving passages 20 and 24 have a different (in this case, larger) cross-section at cable receiving end 14 than at terminal receiving end 16. In addition, wire-receiving passages 20 and 24 at cable receiving end 14 are coordinately positioned with respect to wire-receiving passages 18 and 22 differently than at terminal receiving end 16. It is noted that at terminal receiving end 16, longitudinal axes 48 and 50 of wire-receiving passages 20 and 24, respectively, are also generally coplanar, but are not coplanar with longitudinal axes 38 and 40 at cable receiving end 14.

Figure 1D:
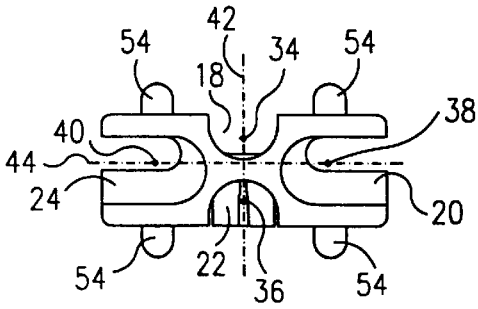
FIG. 1D is a simplified end view of the cable organizer of FIGS. 1A–1C as viewed from a cable receiving end thereof.

It is further noted that wire-receiving passages 18, 20, 22 and 24 are symmetrically arranged with respect to each other at cable receiving end 14, as seen in FIG. 1D. However, at terminal receiving end 16, whereas wire-receiving passages 20 and 24 are symmetrically arranged with respect to each other, wire-receiving passages 18 and 22 are not, but rather are arranged differently with respect to each other at cable receiving end 14 than at terminal receiving end 16. As seen in FIG. 1C, wire-receiving passage 22 preferably has a bifurcation 52 formed therein at terminal receiving end 16. Bifurcation 52 divides wire-receiving passage 22 into two wire-receiving passages 22A and 22B. Bifurcation 52 can be electrically conductive, although this is not necessary.

Elongate body 12 also preferably includes pins 54 adapted to align attachment of body 12 to a modular plug, as described further hereinbelow.

Figure 2:
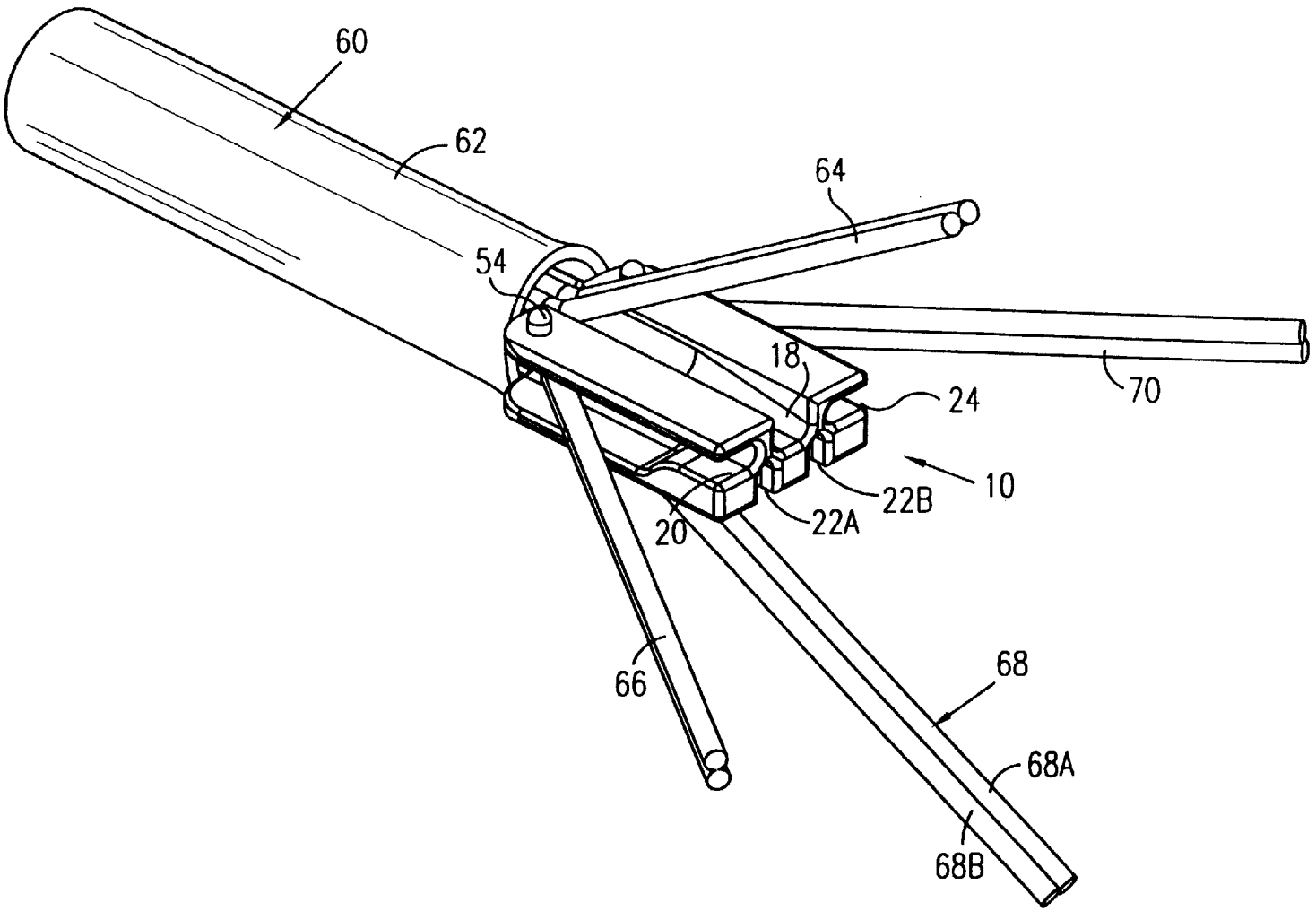
FIG. 2 is a simplified pictorial illustration of assembling the organizer of FIGS. 1A–1D with a multi-pair communication cable, in accordance with a preferred embodiment of the present invention.

Reference is now made to FIGS. 2–7 which illustrate assembly of cable organizer 10 with a multi-pair communication cable 60, in accordance with a preferred embodiment of the present invention. As is well known in the art, cable 60 preferably includes an insulating sheath 62 and four or more wire pairs 64, 66, 68 and 70, which may be twisted wire pairs. As is seen in FIG. 2, wire pairs 64, 66, 68 and 70 are arranged to lie in wire-receiving passages 18, 20, 22 and 24, respectively. Wire pair 68 becomes divided at terminal receiving end 16 into wires 68A and 68B which lie in wire-receiving passages 22A and 22B, respectively.

Figure 3:
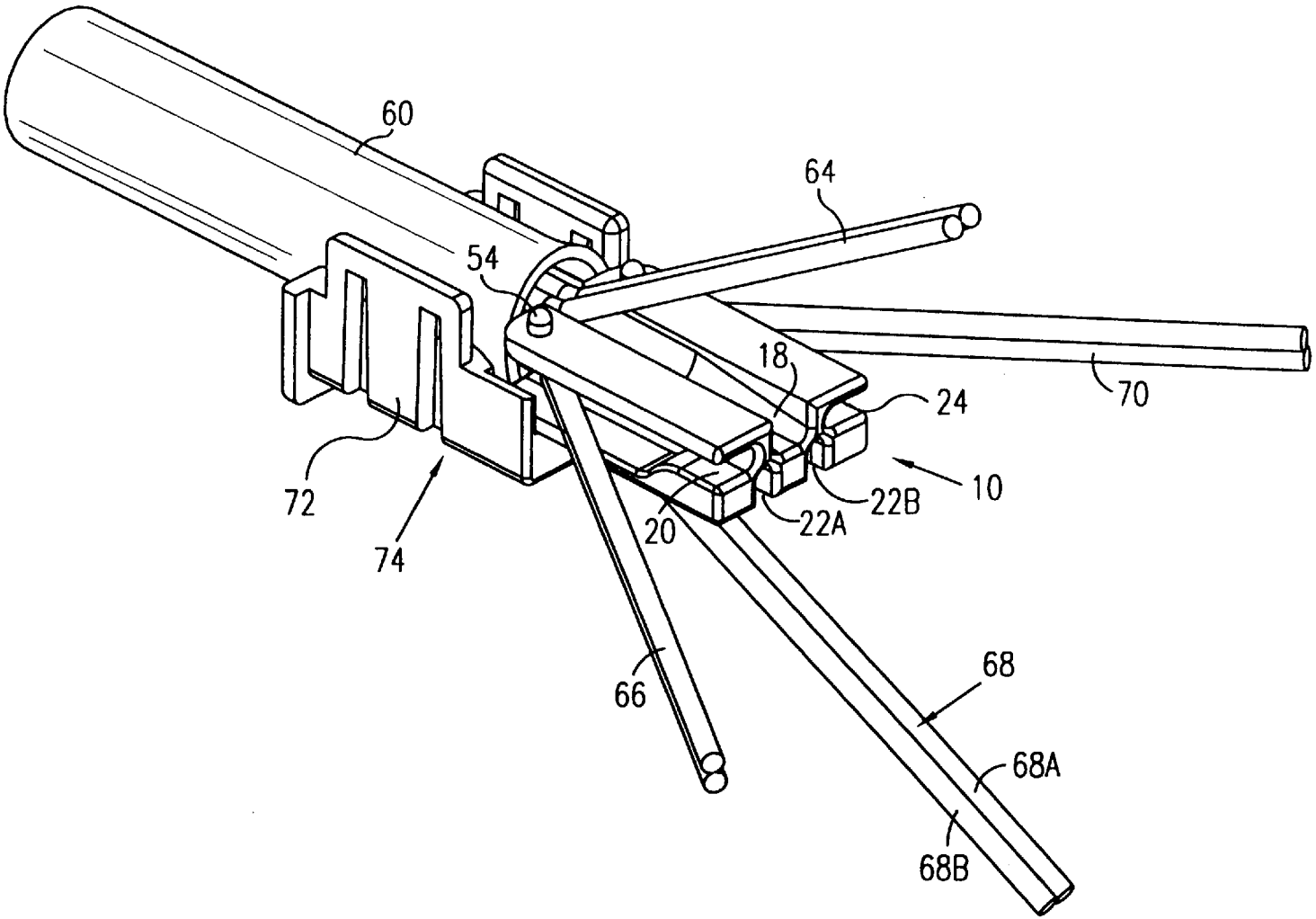
FIG. 3 is a simplified pictorial illustration of affixing a lower, inner portion of a modular plug on the multi-pair communication cable.
Figure 4:
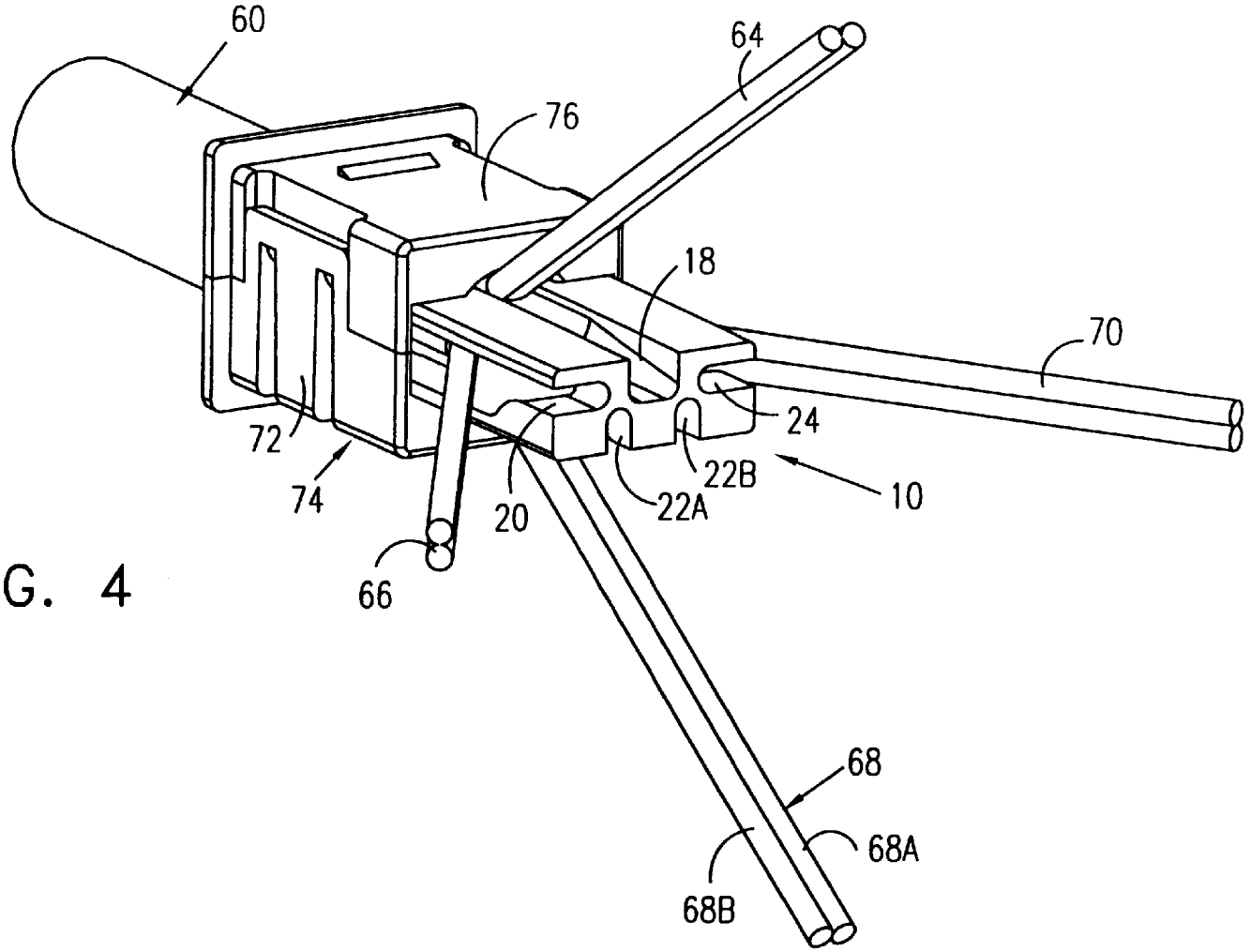
FIG. 4 is a simplified pictorial illustration of fastening an upper, inner portion of the modular plug to the lower, inner portion of the modular plug.

In FIG. 3, a lower portion 72 of a strain relief part 74 is affixed on multi-pair communication cable 60. In FIG. 4, an upper portion 76 of strain relief part 74 is fastened, such as by snap-fit, to the lower portion 72. Pins 54 of elongate body 12 may help align strain relief part 74 with organizer 10. In FIG. 5, wire pairs 64, 66, 68 and 70 of cable 60 are inserted into a terminal receiver 78. Thus simply by inserting wire pairs 64, 66, 68 and 70 into the cable receiving ends 14 of wire-receiving passages 18, 20, 22 and 24, respectively, the wire pairs automatically become arranged at the terminal receiving ends 16 for insertion into terminal receiver 78, such as in accordance with the standard arrangement of IEC 603-7 modular plugs.

In FIGS. 6 and 7, an outer dielectric housing 80 of a modular plug 79 is assembled over the inner portions 72 and 76 and terminal receiver 78 (not visible in FIGS. 6 and 7). As is well known in the art, dielectric housing 80 has a cable-receiving rearward end 82 and a terminal-receiving end 84. As seen in FIG. 7, at terminal-receiving end 84, flat contact terminals 86 electrically contact wire pairs 64, 66, 68 and 70, by piercing through insulation thereof In the final assembly of modular plug 79, cable organizer 10 substantially reduces or even eliminates cross-talk between the wire pairs by providing an electrically conductive barrier between the wire pairs up until the wire pairs are actually inserted into terminal receiver 78.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A cable organizer comprising:

an elongate body having an elongate axis and a cable receiving end and a terminal end; and a plurality of wire-receiving passages formed in said elongate body and separated from each other by electrically conductive portions in said body, each wire-receiving passage extending from the cable receiving end to the terminal end and being open at both said ends, each wire-receiving passage being adapted for guiding therethrough a plurality of wires of a multi-pair communication cable from the cable receiving end to the terminal end, and being adapted for arranging said plurality of wires at the terminal end for connection with a modular plug, at least one of said wire-receiving passage including first and second mutually parallel, but not coaxial, elongate surface portions, each extending parallel to said elongate axis, and an intermediate surface portion joining said first and second elongate surface portions, said intermediate portion being not parallel to said first and second elongate surface portions.

2. The cable organizer according to claim 1 wherein at least one of the wire-receiving passages has a different cross-section at said cable receiving end than at said terminal end.

3. The cable organizer according to claim 1 wherein at least two of said wire-receiving passages are symmetrically arranged with respect to each other at said cable end.

4. The cable organizer according to claim 1 wherein at least two of said wire-receiving passages are symmetrically arranged with respect to each other at said terminal end.

5. The cable organizer according to claim 1 wherein at least two of said wire-receiving passages are symmetrically arranged with respect to each other at said cable receiving end, but are arranged differently with respect to each other at said terminal end.

6. The cable organizer according to claim 1 wherein at least one of the wire-receiving passages is coordinately positioned with respect to another of the wire-receiving passages differently at the cable receiving end than at said terminal end.

7. The cable organizer according to claim 1 wherein at least one of the wire-receiving passages has a ramp formed therein at the terminal end.

8. The cable organizer according to claim 1 wherein at least one of the wire-receiving passages has a bifurcation formed therein at the terminal end, said bifurcation being adapted to separate two wires of a multi-pair communication cable.

9. The cable organizer according to claim 1 wherein said plurality of wire-receiving passages comprises at least four wire-receiving passages, a first wire-receiving passage being positioned on an upper surface of said elongate body, a second wire-receiving passage being positioned on a lower surface of said elongate body, a third wire-receiving passage being positioned on a left side surface of said elongate body, and a fourth wire-receiving passage being positioned on a right side surface of said elongate body.

10. The cable organizer according to claim 9 wherein longitudinal axes of said first and second wire-receiving passages are generally coplanar and parallel to each other at said cable receiving end.

11. The cable organizer according to claim 9 wherein longitudinal axes of said third and fourth wire-receiving passages are generally coplanar and parallel to each other at said cable receiving end.

12. The cable organizer according to claim 9 wherein longitudinal axes of said third and fourth wire-receiving passages are generally coplanar at said terminal end.

13. The cable organizer according to claim 9 wherein longitudinal axes of said first and second wire-receiving passages are generally coplanar and parallel to each other at said cable receiving end, longitudinal axes of said third and fourth wire-receiving passages are generally coplanar and parallel to each other at said cable receiving end, and a plane of said first and second wire-receiving passages is generally perpendicular to a plane of said third and fourth wire-receiving passages.

14. The cable organizer according to claim 1 wherein said elongate body comprises pins adapted to align said elongate body to a modular plug.

15. The cable organizer according to claim 1 further comprising a plurality of wires of a multi-pair communication cable disposed in said wire-receiving passages from the cable receiving end to the terminal end.

16. The cable organizer according to claim 15 further comprising a modular plug, wherein said plurality of wires of said multi-pair communication cable are connected to said modular plug at the terminal end.

* * * * *